US007105062B2

(12) United States Patent
Crichton

(10) Patent No.: US 7,105,062 B2
(45) Date of Patent: Sep. 12, 2006

(54) CLEANING METHOD FOR AN OIL TANK BURNER SYSTEM

(76) Inventor: Brian Crichton, P.O. Box 1085, Cold Lake, Alberta (CA) T9M 1P3

( * ) Notice: Subject to any disclaimer, the term of this patent is extended or adjusted under 35 U.S.C. 154(b) by 0 days.

(21) Appl. No.: 10/984,315

(22) Filed: Nov. 8, 2004

(65) Prior Publication Data

US 2006/0096616 A1 May 11, 2006

(51) Int. Cl.
*B08B 9/027* (2006.01)
*B08B 9/032* (2006.01)

(52) U.S. Cl. ..... 134/24; 134/22.11; 134/22.12; 134/22.18; 134/8

(58) Field of Classification Search ..... 134/22.11, 134/22.12, 22.18, 24, 8
See application file for complete search history.

(56) References Cited

U.S. PATENT DOCUMENTS 1,676,019 A 7/1928 Girtanner
3,733,788 A 5/1973 Crowley
4,168,958 A 9/1979 Hartman
4,452,614 A 6/1984 Kovac
4,546,519 A 10/1985 Pembroke
4,834,883 A 5/1989 Lake
5,063,632 A 11/1991 Clark et al.
5,099,543 A 3/1992 Wade
5,237,718 A 8/1993 Brown
5,584,094 A 12/1996 Gurstein
6,391,121 B1 5/2002 Sivacoe
6,506,235 B1 1/2003 Gertner-Hansen

*Primary Examiner*—Zeinab El-Arini
(74) *Attorney, Agent, or Firm*—Donald V. Tomkins

(57) ABSTRACT

A method for cleaning an exhaust stack tube of an oil tank heater comprises the steps of securing collection drums at open ends of a heater tube using attaching straps; securing a drop cloth over an exhaust end of the heater tube with an attaching strap; interconnecting the collection drums to one of a vacuum apparatus and a receptacle container; attaching a nozzle to an end of a high pressure hose; inserting the nozzle under the drop cloth and into an exhaust end of the heater tube; forcing wash water under pressure through the nozzle; guiding the nozzle to the top of the exhaust stack; pulling the nozzle back a few feet and, again, guiding the nozzle upward while rotating the nozzle; and repeating this process until the nozzle reaches the bottom of the exhaust stack.

12 Claims, 2 Drawing Sheets

CLEANING METHOD FOR AN OIL TANK BURNER SYSTEM

BACKGROUND OF THE INVENTION

Related Applications

None

INCORPORATION BY REFERENCE

Applicant hereby incorporates herein by reference, the U.S. patents and U.S. patent applications, if any, referred to in the Description of Related Art section of this application as filed.

FIELD OF THE INVENTION

This invention relates generally to industrial cleaning and clean-up methods and more particularly to a process for removing contaminates from heater tubes and stacks and collecting them for disposal.

DESCRIPTION OF RELATED ART

The following art defines the present state of this field and each disclosure is hereby incorporated herein by reference:

Girtanner, U.S. Pat. No. 1,676,019 describes a device of the class described (for the removal of soot from pockets and other parts of boilers where soot and fine dust constantly accumulate), the combination with a tubular suction member adapted to be inserted through a space where dust may accumulate, said suction member being provided with spaced inlets throughout its length, of a movable bar mounted upon and longitudinally extending above said tubular member and means carried by said bar adapted to break up and loosen the caked dust collected within said space.

Crowley, U.S. Pat. No. 3,733,788 describes an apparatus for cleaning a stack smoke by removing particulate and gaseous pollutants therefrom, having a conduit in the stack for conducting the stack smoke therethrough and a conical deflector spaced above and across the top of the conduit to provide an annular passage for the stack smoke and a nozzle to deliver a curtain of water transversely to the direction of the deflected stack smoke to remove pollutants, the water then flowing to a collection tank and outlet line for discharge from the stack.

Hartman, U.S. Pat. No. 4,168,958 describes a cleaner for the products of combustion in a smoke stack in the form of a vertically elongated chamber having a multiplicity of inclined baffles extending from opposite sides of the chamber to beyond the center line thereof and water spray devices located intermediate of each pair of vertically spaced baffles. In the preferred form, the baffles are inclined inwardly and upwardly, so that water from the nozzles flows to the outer edges of each baffle where it is connected to a drain.

Kovac, U.S. Pat. No. 4,452,614 describes a dust and soot collector that surrounds a top portion of a stack or duct. Sprays of water are directed across a path of a gas flow exiting the stack. The water removes particles of dust and soot from the gas. A slush is created which falls into a peripheral trough and is removed.

Pembroke, U.S. Pat. No. 4,546,519 describes an apparatus for cleaning tubes which apparatus comprises a hollow barrel which is connected to a primary drum containing a coiled resilient tape so that the tape may pass from the drum along and out of one end of the barrel, an electric motor operatively connected to an inner end of the coil of tape and arranged to rotate the coil of tape and to drive the tape out of the barrel and to retract it into the drum, a cleaning device such as a brush attached to an outer end of the coil of tape, and a vacuum hose connected to the other end of the barrel and adapted for connection to a vacuum generating apparatus to create suction at said one end of the barrel, in which apparatus there is provided associated with the drum and the coil of tape a proximity switch sensor and a plurality of targets adapted to be sensed by the proximity switch sensor, relative rotation between the sensor and the targets causing the sensor to transmit impulses to a visible display device to indicate the amount of tape unwound from the coil.

Lake, U.S. Pat. No. 4,834,883 describes the filter tubes of a swimming pool filter which are cleaned by a spray nozzle connected to a high pressure water source and carried on the end of a wand adapted to be inserted slidably through the drain valve and moved back and forth to cause the spray nozzle to traverse back and forth beneath the tubes. Dirty water from the filter is discharged around the wand and through the drain valve.

Clark et al, U.S. Pat. No. 5,063,632 describes a sootblower for the cleaning of internal surfaces of large scale boilers which are subject to the accumulation of soot or slag encrustations. In instances where a sootblower is used to project the jet of steam or a steam/air mixture, between actuation cycles, condensate can form in the sootblower or the associated piping. At the beginning of an actuation cycle the condensate is ejected from the sootblower. If the condensate impinges against the heat transfer surfaces inside the boiler it can cause damage to these surfaces through excessive thermal and mechanical shock. In accordance with this invention the sootblower is provided with a nozzle block assembly incorporating a condensate separator which causes condensate to be ejected by the lance tube away from impact with the heat transfer surfaces where it can be safely dissipated from the boiler without causing damage to the heat transfer surfaces which are cleaned using a substantially fully vaporous pure spray of sootblowing medium.

Wade, U.S. Pat. No. 5,099,643 describes a cleaning apparatus including a support device for supporting a spray member for receiving and spraying hot liquid onto a surface to be cleaned and a vacuum head for withdrawing liquid and material from the surface by reduced pressure. Also included are a container, a manifold having first and second chambers, a pump, and a heat exchanger. The heat exchanger inlet is coupled to the first chamber and a flexible high pressure liquid conduit is coupled to the heat exchanger outlet and to the spray member by way of a control valve. The pump inlet is coupled to the second chamber and the pump outlet is coupled to the first chamber. A return conduit is coupled from the flow control valve to the second chamber. A pressure adjustment valve is coupled to the two chambers for controlling variations of the pressure in the two chambers and hence at the pump outlet.

Brown, U.S. Pat. No. 5,237,718 describes a sootblower for use in cleaning heat exchanger surfaces in which a drain is provided for selectively draining a portion of the blowing medium from the sootblower lance tube for discarding externally of the heat exchanger. The lance tube drain enables the discharge of blowing medium from the lance tube into the heat exchanger to be reduced during portions of a cleaning cycle in which the lance tube nozzles are not directed toward a surface to be cleaned yet enabling a minimum flow of blowing medium through the lance tube for cooling or other purposes without discharging the minimum flow of blow medium into the heat exchanger.

Gertner-Hansen, U.S. Pat. No. 6,506,235 describes a method of cleaning flue gases from gaseous pollutants formed during combustion of oil during start-up of a boiler and/or operational disturbances in the boiler, wherein the boiler is for combustion of fuel including one of fossil fuel, coal, biomass fuel and waste. Flue gases are conducted from the boiler through a flue duct to a barrier filter for separation of particulate pollutants. Finely-dispersed particles are introduced into and mixed with the flue gases in the flue duct in at least one of upstream of and in the barrier filter. The finely-dispersed particles are separated in the barrier filter while forming a dust cake. Condensed gaseous pollutants and droplets are taken up on the surface of the finely-dispersed particles in the flue gases and in the dust cake.

Sivacoe, U.S. Pat. No. 6,391,121 describes a method of cleaning tubing in an operating heater, in which the tubing has an inlet and an outlet. While the heater is in operation, a pig is run through the tubing from the inlet to the outlet and then returned to the inlet along return tubing, in parallel connection to the heater tubing. A combined pig launcher and receiver mounted parallel to the tubing, and controlled with three way full port valves, is used to launch pigs into the tubing and remove them from the tubing. A boost pump is used to force pigs back from outlet to inlet.

Gurstein, U.S. Pat. No. 5,584,094 describes an extraction cleaning device of the type having a cleaning head (60), a vacuum system (70, 80, 90) for applying suction at the cleaning head, a holding tank (10) for holding cleaning liquid, a pump (20) for pressurizing the liquid, and a delivery line for delivering the pressurized liquid to the cleaning head wand, where it is sprayed onto a carpet, upholstery, etc. The device is improved by the addition of a pressure reduction valve, having a calibrated orifice, which is hydraulically connected between the liquid delivery line and a return line to the holding tank. When the reduction valve is open, the delivery line pressure is reduced by the added leakage; this allows switching between high pressure jet spray for carpets and low pressure jet spray for upholstery, drapes, etc. For easy opening and closing of the reduction valve, it is preferably a solenoid valve activated by a switch.

Our prior art search with abstracts described above teaches: a soot removing device, an apparatus for removing particulate and gaseous pollutants from stack smoke, a smoke stack air washer, an apparatus for collection of dust and soot by wetting, an apparatus for cleaning tubes, a filter cleaning apparatus, a sootblower with condensate separator, a pump system for cleaning apparatus, a sootblower with lance bypass flow, a method of cleaning flue gases, a method of cleaning a heater, and a dual pressure extraction cleaner. Thus, the prior art shows, that it is possible to clean flues and flue gases effectively. However, the prior art fails to teach a method using a water nozzle with forward jet, closed soot collector with drop cloth, catch drums, runoff troughs and connection hoses, which is environmentally friendly, eliminates contamination in the vicinity, and need to replace tank area fill, and provides a nozzle capable of climbing and cleaning to the top of an exhaust stack. The present invention fulfills these needs and provides further related advantages as described in the following summary.

SUMMARY OF THE INVENTION APPARATUS

The present invention teaches certain benefits in construction and use which give rise to the objectives described below.

Oil storage tanks are usually equipped with heaters to lower the viscosity of the stored oil so that it is easier to pump. This operation produces soot which eventually flakes off the walls of tubes and tank walls. This can result in blocked air flow in the system, inefficient heating, hot spots and distortion of tubes. The prior art teaches the cleaning of tubes using high pressure water jets. This produces undesirable effects including soot emissions, which are expensive to overcome and deal with when using conventional techniques and known art.

In one of the best mode preferred embodiments of the present invention, the apparatus consists of two collection drums that are attached to a heater tube's ends in such a fashion that they catch anything that is washed out. The drums are connected to hoses or to runoff troughs that allow all the washings to be funneled to a collection vessel for containment and disposal. When the hoses are attached to the drums, they further attach to a tee fitting that is connected to a coupling that allows the attachment of a vacuum hose. The vacuum hose attaches to a vacuum unit that sucks the washings into a vacuum tank for transport to a disposal. When the runoff troughs are attached to the drums, they gravity feed the washings to a large drum or container where they are held for future pick up and transport to a disposal. A drop cloth is secured over the tube end and draped into the collection drum. Its purpose is to 'catch' airborne particles that are ejected rearward by the high pressure hose and deposit these particles into the drum.

The hose is fitted with a nozzle. The nozzle or tip has one hole or jet pointing forward and several jets pointing rearward. For the purpose of cleaning burners, the tip's forward jet is plugged preventing it from blowing particles forward out of the top of the stack and out of the end of the tube thus eliminating airborne soot from contaminating the surrounding area.

A primary objective of the present invention is to provide an apparatus and method of use of such apparatus that yields advantages not taught by the prior art.

Another objective of the invention is to enable the cleaning of a soot laden stack without generating air-borne particulate.

A further objective of the invention is enable such cleaning while capturing all of the particulate in an aqueous runoff.

A still further objective of the invention is to place an oil tank burner into highly clean condition quickly and with relatively little post operational cleanup time or labor.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

Figure 1:
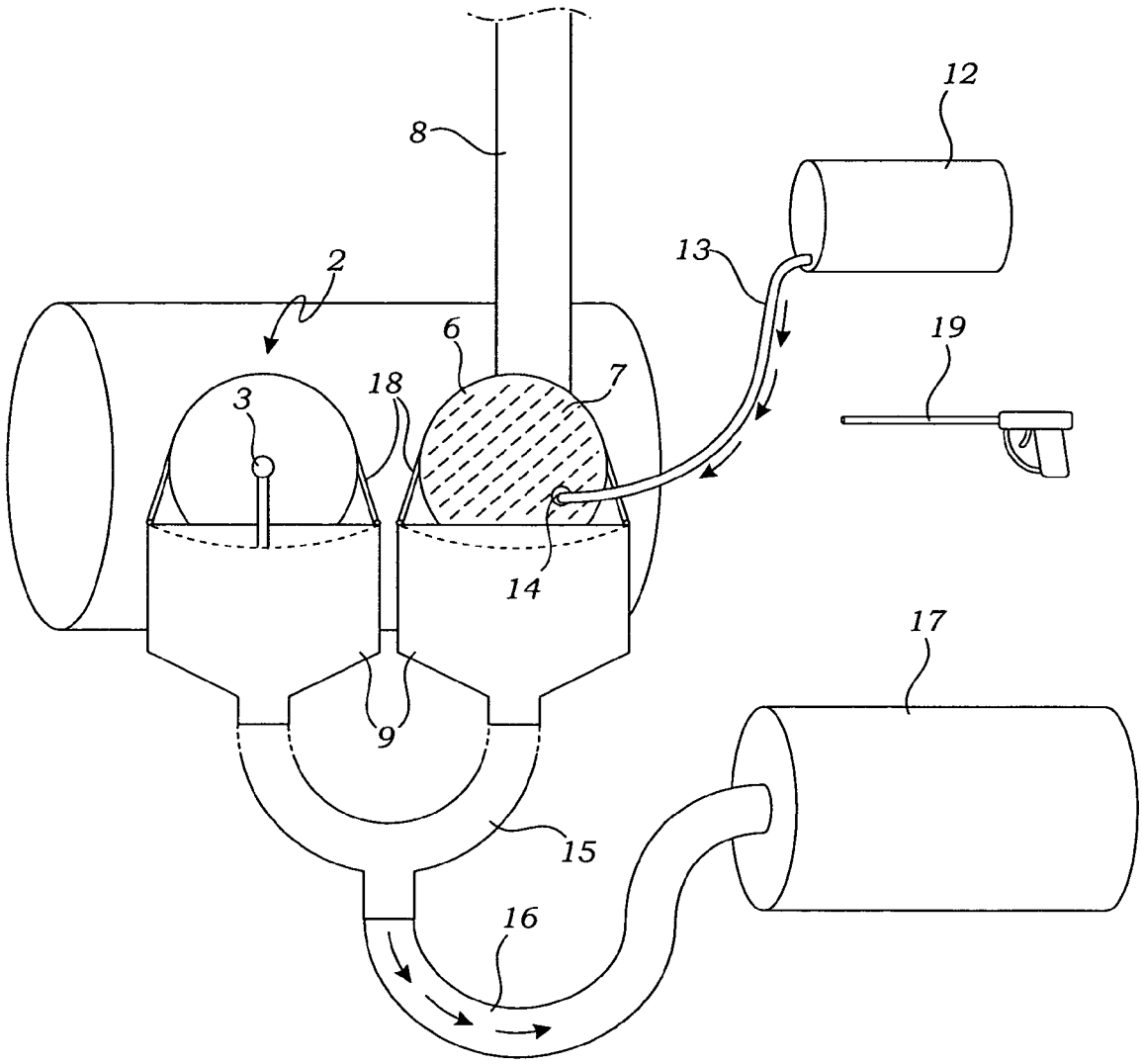
FIG. 1 is a schematic view of the apparatus used in one embodiment of the present invention method.
Figure 2:
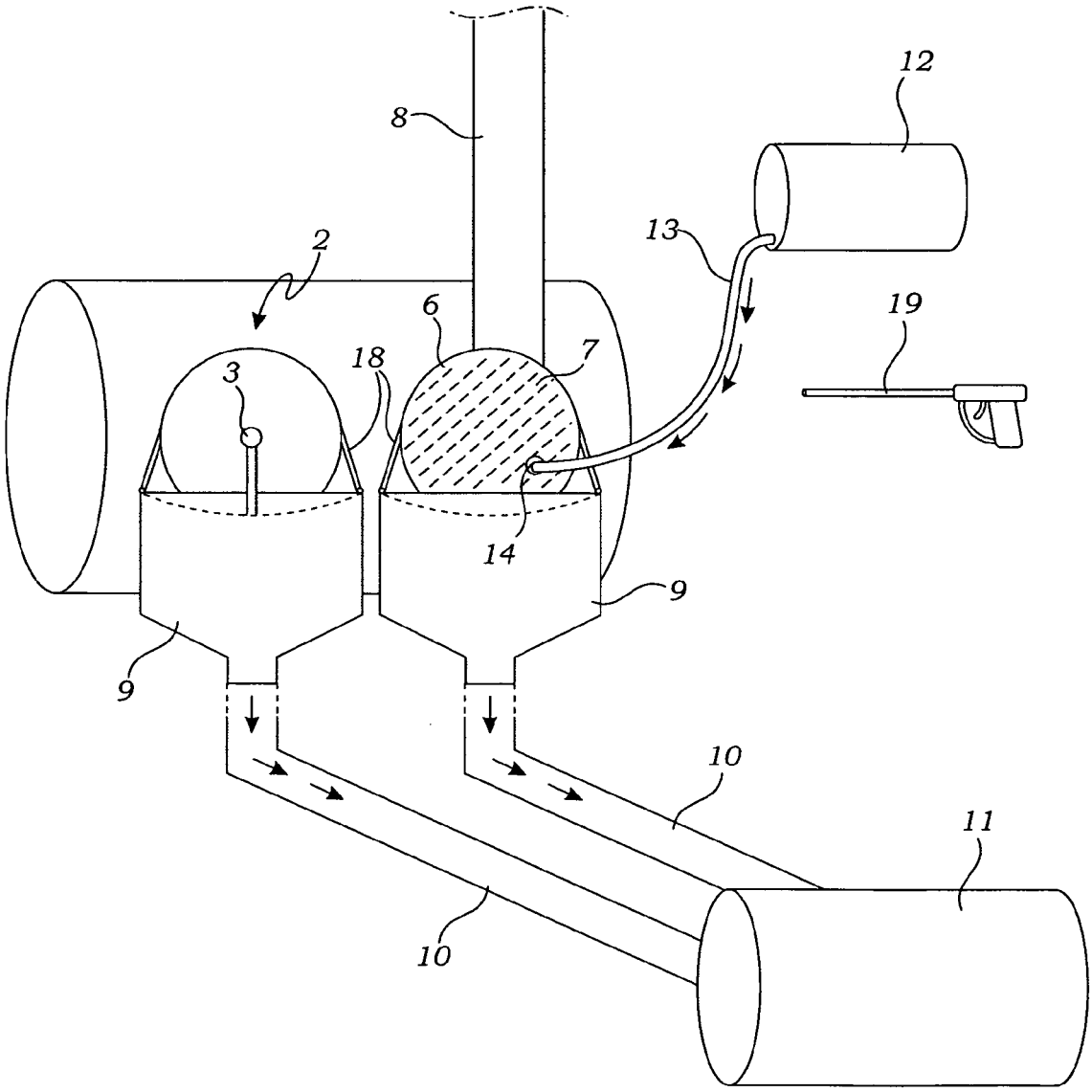
FIG. 2 is a schematic view of the apparatus as used in an alternate embodiment of the present invention method.

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

In one embodiment of the present invention method, burner ends are dismantled allowing free access to a heater tube and its stack where the heater tube has open ends. Collection drums (9) are placed; one on each open end of the tube (6) and secured by attaching straps (18). A drop cloth (7), or other cover capable of deflecting debris, is draped or placed over an exhaust end of the tube (6) and the top half is secured with an attaching strap (18) leaving the bottom half loosely draped into the drum (9) as shown in the figures. An operator interconnects connecting hoses (15) and (16) to vacuum apparatus (17) or runoff troughs (10) for gravity feed to a receptacle container (11).

A modified nozzle (14) is attached to an end of a high pressure hose (13) and is then inserted under the loose portion of the drop cloth (7) and into the exhaust end of the tube (6). A high pressure wash unit (12) is activated and wash water is forced through the nozzle (14).

The nozzle (14) is manually guided up exhaust stack (8) until it reaches the top. It is then pulled back a few feet and then pushed up again with ¼ turn of rotation, and then pulled back a farther distance, then pushed up with ¼ turn rotation, pulled back further yet, and in this way repeating the same operation until the entire length of the stack (8) has been blasted and rinsed with the high pressure water.

Upon completion of the stack (8), the nozzle (14) is directed into the exhaust end of the tube (6), the drop cloth (7) is tucked into the collection drum (9) and the nozzle (14) is pushed forward. After a few feet of forward motion, the nozzle (14) is rotated one turn and pulled back to the starting position, drawing the loosened particles back to the entrance where they are deflected by the drop-cloth (7) and guided into the collection drum (9). The nozzle (14) is then pushed farther into the tube (6) where it loosens more particles, is turned or rotated ¼ turn and pulled back to the entrance. This forward, ¼ turn, pull back motion is continued until the nozzle (14) appears at the burner end (2) of the tube (6) indicating completion of the wash cycle.

At this time, the water pressure is turned off allowing the nozzle (14) to be removed from the exhaust end of the tube (6). The nozzle (14) is then inserted into the burner end (2) of the heater tube (6), the water pressure is turned on and the process is repeated. This allows the high pressure water to loosen any stubborn particles that remain in the tube by blasting them from the opposite direction and allows for a rinse to remove more of the loosened particles. The high pressure water is then turned off and the tube is inspected with the aid of a high power light. If necessary, the cleaning process is repeated until all the particles and debris are removed from the tube (6).

Upon completion of the cleaning process, the nozzle (14) is removed from the hose (13) and a wash wand (19), is attached to hose (13). The burner end (2) of heater tube (6) often has stubborn particles that are baked onto the tube walls and will not loosen with the nozzle (14) pressure so it becomes necessary to blast them away with the use of the wash wand (19). The wash wand (19) has a more powerful spray and is better able to loosen any remaining particles. The loosened particles are pushed out of the tube (6) by means of the spray from the wash wand (19). This high pressure spray also provides a final rinse for the cleaning process to drive out any remaining debris and sooty water that may remain in the tube (6).

The wash wand (19) is then used to blast out a burner assembly (3) to remove all particles that have collected in the fuel gas chambers, to rinse any remaining soot or particles from the tube ends and out of the collection drums (9), to blast out air filters and to rinse the work area to wash any soot or debris down to the ground leaving a clean work place.

Upon completion of this final rinse, the collection drums (9) and attaching hardware are removed, the burner is reassembled and is ready for use.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method for cleaning a heater tube or exhaust stack heater, said oil tank heater having a heater tube with an open burner end and an open exhaust end, an exhaust stack with a top end and a bottom end, said bottom end of the exhaust stack being in communication with the heater tube near the exhaust end thereof, said method comprising the steps of:

(a) providing first and second containment drums, each having a top opening and a drain;

(b) securing the first drum over said burner end, and securing the second drum over said exhaust end;

(c) connecting drain conduit means between the drains of said drums and a debris-receiving means;

(d) securing a debris-deflecting cover means over the exhaust end such that said debris-deflecting cover means can deflect debris exiting the exhaust end into the second drum through the top opening thereof;

(e) providing a hose connected at one end to a high-pressure water source, and connected at the other end to a nozzle, said nozzle having a plurality of rearwardly-directed jets;

(f) inserting the nozzle under the debris-deflecting cover means, through the exhaust end of the heater tube, and into the exhaust stack through the bottom end thereof;

(g) activating the high-pressure water source so as to force high-pressure water out the rearwardly-directed nozzle jets; and (h) moving the nozzle upward within the exhaust stack, such that high-pressure water exiting rearwardly from the rearwardly-directed nozzle jets is directed against interior surfaces of the stack so as to loosen accumulated debris therefrom, and so as to wash loosened debris downward within the stack and out the exhaust end of the heater tube, whereupon the debris is directed into the second containment drum by the debris-deflecting cover means;

whereupon debris washed into the second containment drum passes through the drain thereof, and is conveyed to the debris-receiving means by the drain conduit means.

2. The method of claim 1 comprising the further step of rotating the nozzle while it is positioned within the exhaust stack.

3. The method of claim 1 comprising the further steps of:

(a) inserting the nozzle into the heater tube through the exhaust end thereof; and (b) moving the nozzle within the heater tube, such that high-pressure water from the nozzle jets is directed against interior surfaces of the tube so as to loosen accumulated debris therefrom, and so as to wash loosened debris out the exhaust end of the heater tube, whereupon the debris is directed into the second containment drum by the debris-deflecting cover means.

4. The method of claim 3 comprising the further step of rotating the nozzle while it is positioned within the heater tube.

5. The method of claim 3 comprising the further step of using a wash wand to loosen additional debris from interior surfaces of the heater tube.

6. The method of claim 1 comprising the further steps of:

(a) securing the debris-deflecting cover means over the burner end of the heater tube such that said debris-deflecting cover means can deflect debris exiting said burner end into the first containment drum through the top opening thereof;

(b) inserting the nozzle under the debris-deflecting cover means and into the heater tube through the burner end thereof; and (c) moving the nozzle within the heater tube, such that high-pressure water from the nozzle jets is directed against interior surfaces of the tube so as to loosen accumulated debris therefrom, and so as to wash loosened debris out the burner end of the heater tube, whereupon the debris is directed into the first containment drum by the debris-deflecting cover means;

whereupon debris washed into the first containment drum passes through the drain thereof, and is conveyed to the debris-receiving means by the drain conduit means.

7. The method of claim 6 comprising the further step of rotating the nozzle while it is positioned within the heater tube.

8. The method of claim 6 comprising the further step of using a wash wand to loosen additional debris from interior surfaces of the heater tube.

9. The method of claim 1 wherein the debris-deflecting cover means is a drop cloth.

10. The method of claim 1 wherein the drain conduit means comprises two primary conduits, each of which extends between one of the containment drum drains and the debris-receiving means.

11. The method of claim 1 wherein the drain conduit means comprises two primary conduits extending from each containment drum drain and joined to a secondary conduit by means of a tee fitting, said secondary conduit being connected to the debris-receiving means.

12. The method of claim 11 wherein the debris-receiving means comprises a vacuum apparatus, for sucking washings from the containment drums into a vacuum tank.

* * * * *